US005680003A

United States Patent [19]

Hartwick et al.

[11] Patent Number: 5,680,003

[45] Date of Patent: Oct. 21, 1997

[54] COILED-COIL FILAMENT DESIGN FOR AN INCANDESCENT LAMP

[75] Inventors: Robert W. Hartwick, Charleston; Robert J. Kellner, Mattoon; Joseph P. Lagermasini, III, Charleston, all of Ill.; Bernard W. Rachel, Highland Heights, Ohio

[73] Assignee: General Electric Company, Schenectady, N.Y.

[21] Appl. No.: 444,952

[22] Filed: May 19, 1995

[51] Int. Cl.[6] ..... H01J 1/02

[52] U.S. Cl. ..... 313/271; 313/315; 313/341; 313/344; 313/578; 313/579

[58] Field of Search ..... 313/578, 579, 313/315, 271, 341, 344

[56] References Cited

U.S. PATENT DOCUMENTS

| | | | |
|---|---|---|---|
| 2,258,158 | 10/1941 | Lowry | 313/344 |
| 3,767,959 | 10/1973 | George et al. | 313/344 |
| 4,683,397 | 7/1987 | Johnson, Jr. | 313/344 |

*Primary Examiner*—Nimeshkumar Patel
*Attorney, Agent, or Firm*—George E. Hawranko

[57] ABSTRACT

An improved coiled-coil filament for use in an incandescent lamp has a primary coil winding with a substantially uniform spacing between successive coil turns. The primary coil winding is wound around a second mandrel in a manner to provide a main coil body and leg portions extending therefrom. A helical bend is formed between the main coil body and the leg portions thereby allowing that the leg portions extend toward a seal region of the lamp envelope in a substantially parallel relation to each other. Once the main coil body has been set in shape, the first and second mandrels are removed such that the leg portions are disposed in the seal region of the lamp envelope in a spaceless, and optional spudless manner. In manufacturing the spaceless, spudless coiled-coil filament of the present invention, several manufacturing steps are avoided including the steps of Picco or wax dipping the ends of the leg portions to allow for the formation of the previously required spud members, and of removing the Picco or wax dip after the remainder of the primary mandrel has been dissolved.

5 Claims, 4 Drawing Sheets

Fig. 4
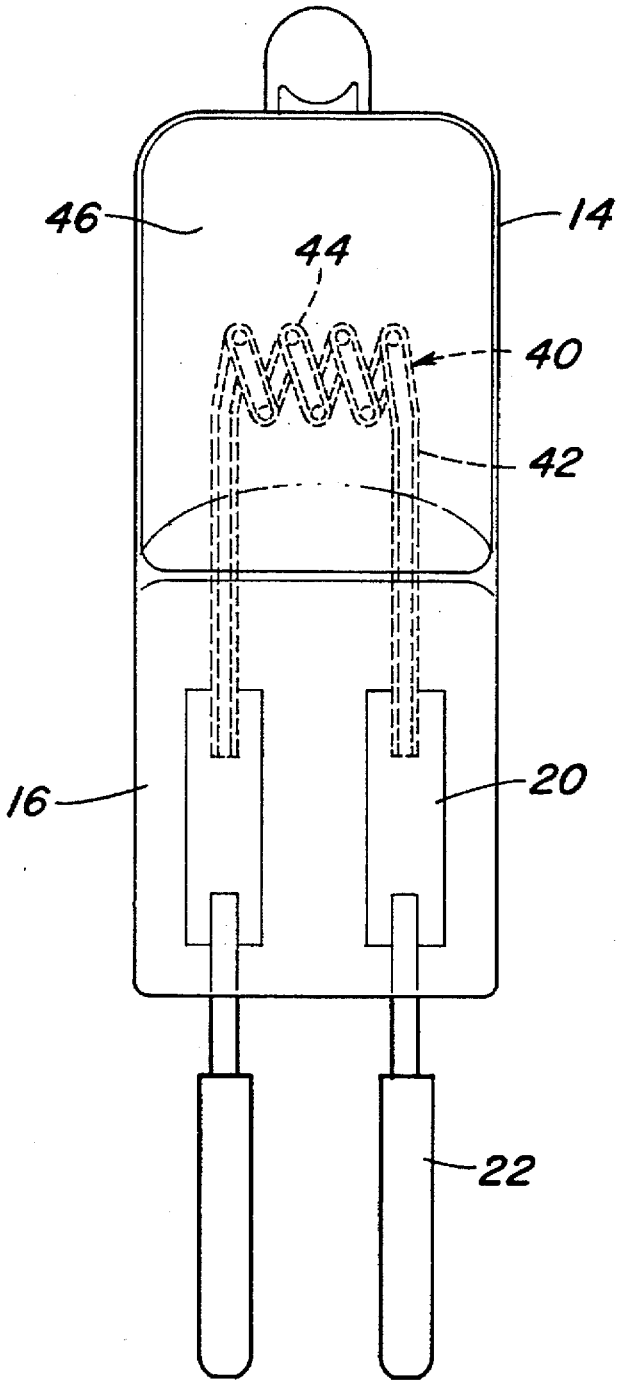
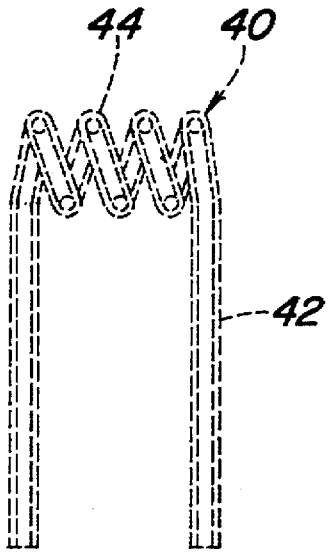
Fig. 5

Fig. 6A
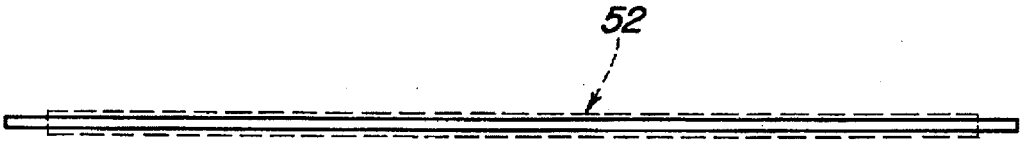
Fig. 6C
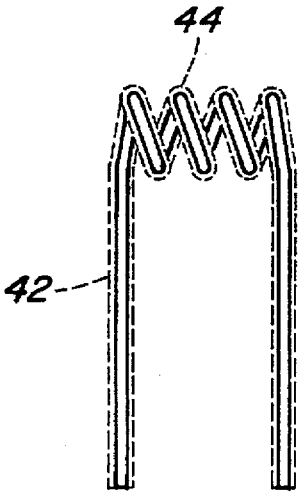
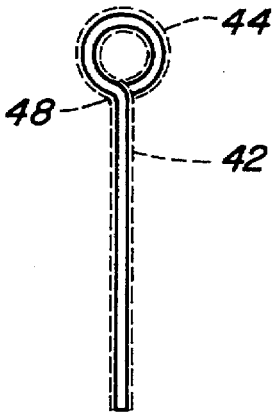
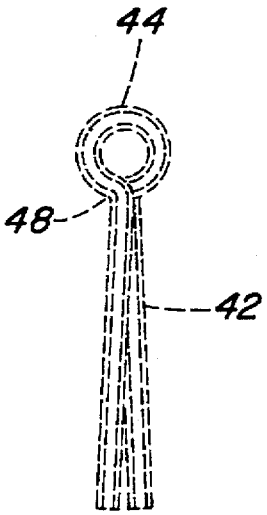
Fig. 6B
Fig. 6D

COILED-COIL FILAMENT DESIGN FOR AN INCANDESCENT LAMP

FIELD OF THE INVENTION

This invention relates to an improved small coiled-coil filament configuration for use with an incandescent lamp such as for instance, a tungsten halogen incandescent lamp. More particularly, this invention relates to such a coiled-coil filament configuration as can be readily produced on an automated high speed manufacturing system at a significant cost savings over existing manufacturing techniques.

BACKGROUND OF THE INVENTION

Small coiled-coil filament configurations are typically utilized in some tungsten halogen incandescent lamps because of their high voltage capabilities and luminous efficacy as compared to a conventional larger coiled-coil filament configuration. Examples of tungsten halogen lamps utilizing small coiled-coil filaments can be found in high voltage photographic axial projection lamps. One such coiled-coil filament configuration is typically the transverse filament designated CC-6. Such small CC-6 filament has a length of about 5 mm. Other coiled-coil lengths are also utilized for various lighting applications and would benefit equally as well from the present invention.

One problem with the present coiled-coil design is that the cost of manufacturing the filament is expensive and very labor intensive. In the present manufacturing process, the resulting filament product must include spaces between the body of the coiled-coil arrangement and the leg portions that are welded to the molybdenum foils used for the pressed seal of the lamp envelope. Moreover, spud elements are sometimes needed within the leg portions of the coiled-coil arrangement disposed in the seal.

In the existing manufacturing process, primary coiling is done on a piece of equipment which winds the primary coil on a primary molybdenum mandrel wherein spacing is formed between the leg segments and the secondary coil body by use of a segmented cam. The spaces formed by the segmented cam are needed for subsequent manufacturing operations involving Picco or wax dipping of the end segments so that during the step of dissolving the primary mandrel from the main coil body, primary mandrel spuds are retained in the leg segments. After the primary coiling is completed, secondary coiling is done on a secondary mandrel and such secondary coiling is done so as to achieve approximately a 75 degrees or 0.2 turn overwind of the leg portions. At this point, prewound sintering forms are manually screwed into the secondary coil to hold the correct coil pitch during a subsequent sintering operation. Additionally, the coil legs are bent by hand to align the legs and are then manually trimmed to the required length. Once the coils have been sintered to stress relieve and to set the shape of the coils, the sintering forms are removed and the legs are then Picco or wax-dipped to allow for retaining the molybdenum mandrel in the legs thus becoming the spuds. Once the primary mandrel has been dissolved from the coil body and a portion of the legs, the Picco or wax residue must be removed. Then the coiled-coil filament is ready for mounting and sealing into the lamp envelope and final lamp assembly.

It would be advantageous if a coiled-coil configuration could be developed that could be manufactured on an automated high speed manufacturing system thus eliminating the need for costly, less uniform manual operations that are presently used. It would be further advantageous if such a coiled-coil filament could achieve improved structural advantages over the existing coiled-coil configuration particularly by elimination of the spacer portion while at the same time maintaining the high voltage and efficacy characteristics of existing small coiled-coil filaments.

SUMMARY OF THE INVENTION

The present invention provides an improved coiled-coil filament arrangement for use in a high efficiency incandescent lamp such as a tungsten halogen lamp. This improved coiled-coil arrangement provides for a more uniform and sturdy construction as compared to similar conventional coiled-coils and does so in a manner that can be implemented on high speed automated manufacturing equipment thereby reducing manufacturing costs and eliminating the need for manual labor to perform various subassembly operations.

In accordance with the provisions of the present invention, there is provided a coiled-coil filament arrangement for use with an incandescent lamp wherein the coiled-coil filament is disposed within a lamp envelope portion of the incandescent lamp in a manner such that lead wires and foils connected to the filament member extend through a sealed region of the lamp envelope to allow connection of power thereto. The coiled-coil filament member includes a primary coil winding which is wound on a primary mandrel so as to achieve a substantially uniform distance between successive turns of the primary coil winding. The coiled-coil filament member also includes a secondary coil winding formed by winding the primary coil winding on a second mandrel, this secondary coil winding forming a main coil body. End portions of the primary coil winding form legs of the coiled-coil filament, such legs extending away from the main coil body into the seal region of the lamp envelope substantially parallel to one another.

BRIEF DESCRIPTION OF THE DRAWINGS

In the following detailed description, reference will be made to the attached drawings in which:

FIG. 4 is an elevational view in section of an incandescent lamp which utilizes the coiled-coil filament member of the present invention;

FIG. 5 is an elevational view in section of a coiled-coil filament constructed in accordance with the teachings of the present invention;

FIGS. 6A through 6D show a progression of 4 different production stages utilized in the production of coiled-coil filaments made according to the present invention.

DETAILED DESCRIPTION OF THE INVENTION

Figure 1:
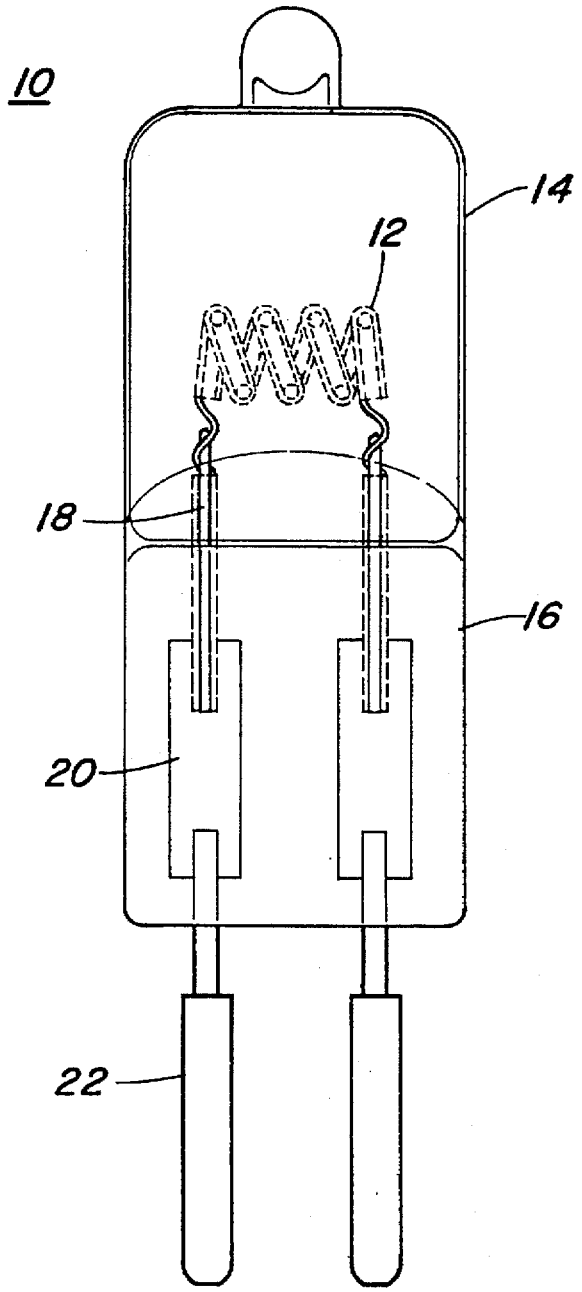
Fig. 1 (PRIOR ART)
FIG. 1 is an elevational view in section of an incandescent lamp which uses a coiled-coil filament constructed in accordance with the teachings of the prior art.

As seen in FIG. 1, an incandescent lamp 10 which utilizes a coiled-coil filament configuration 12 constructed according to known techniques, includes a lamp envelope 14 having a sealed region 16 formed at one end. Leg portions 18 associated with the coiled-coil filament member 12 are welded to a pair of molybdenum foil members 20. The molybdenum foil members 20 also have welded to the opposite end thereof, respective lead wire members 22 which extend out of the sealed region 16 so as to allow for connection of power thereto. As seen in FIG. 1, a portion of the leg portions 18, the molybdenum foil members 20 and a portion of the respective lead wire members 22 are all sealed within the sealed region 16 of the lamp envelope 14. The manner of sealing lamp envelope 14 can include either a press or pinch seal process, as well as a heat shrinking process such sealing processes being known in the art. Furthermore, the shape of the lamp envelope 14 is illustrated as a single ended lamp product, such as can typically be utilized in a projection lamp product that includes a reflector portion such as photo-axial lamps offered by GE Lighting. It should be appreciated that the present invention can be incorporated into various types of lamp envelope configurations as well as those utilizing various sealing types and as such, is not intended to be limited to the illustrations presented herein.

Figure 2:
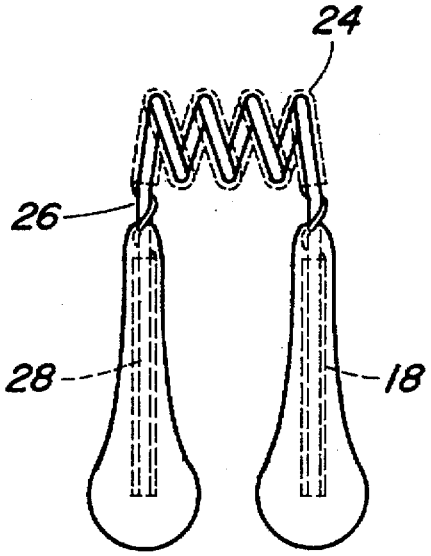
Fig. 2 (PRIOR ART)
FIG. 2 is an elevational view in section of the coiled-coil filament of the prior art.

As seen in FIG. 2, the coiled-coil filament member 12 disposed within the lamp envelope 14 of FIG. 1 includes a main coil body portion 24 from which the leg portions 18 extend. Separating the main coil body 24 from the leg portions 18 are respective spaces 26 the purpose for which will be discussed hereinafter in further detail. Disposed within the leg portions 18 below the spaces 26 are spuds 28 which are formed by portions of the primary mandrel element 30 described below in relation to the manufacturing process utilized for the production of the coiled-coil filament 12 of the prior art.

Figure 3A:
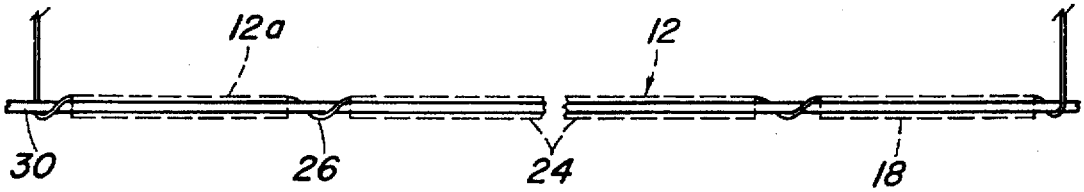
Fig. 3A (PRIOR ART)
FIGS. 3A through 3E show a progression of 5 different production stages utilized in the production of coiled-coil filaments made according to teachings of the prior art.
Figure 3B:
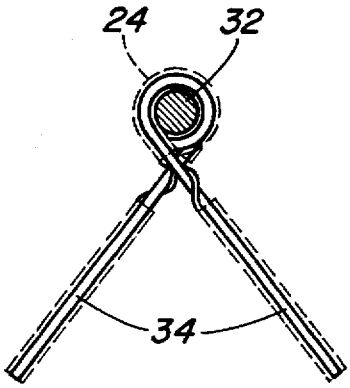
Fig. 3B (PRIOR ART)
Figure 3C:
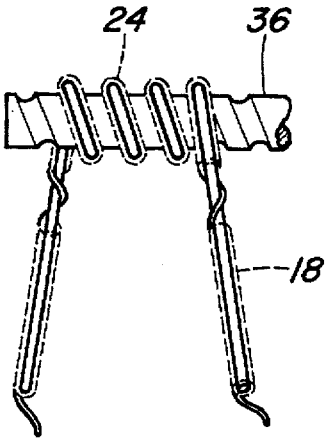
Fig. 3C (PRIOR ART)
Figure 3D:
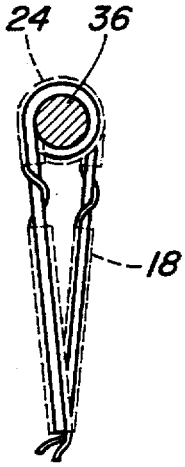
Fig. 3D (PRIOR ART)

As seen in FIG. 3A, the process for manufacturing the coiled-coil filament 12 begins with the step of winding the primary coil 12*a* around a primary mandrel 30 made of molybdenum. The equipment used to perform the coiling operation (not shown) includes a segmented cam (not shown) that is effective for forming repeated sequences of spacers 26, leg portions 18, and main coil bodies 24. Following completion of the primary coiling operation as shown in FIG. 3A, the primary coil 12*a* will typically be annealed in hydrogen so as to stress relieve, soften, and permanently fix the primary coiling. As seen in FIG. 3B, the primary coil is then wound on a secondary mandrel 32 to form the secondary or main coil body 24. The existing equipment (not shown) for performing the secondary coiling will also overwind the ends of the primary coil segment by approximately 75 degrees or 0.2 turns. Following this overwind step which is done on existing automated equipment, prewound sintering forms 36 are manually screwed into the overwound coil segment 34 so as to maintain the correct coil pitch during a subsequent sintering operation, such manual operation being illustrated in FIG. 3C. As seen in FIG. 3D, the subsequent step to the sintering form insertion of FIG. 3C, involves the manual alignment of the coil leg portions 18 while the sintering form 36 is still screwed into the secondary coil of the main coil body 24. As can be seen in the figure, the alignment of the leg portions by hand results in a separation of the leg portions from each other at the region where such leg portions 18 first extend away from the main coil body 24 while then tapering towards each other at the bottom portion of the leg portions 18.

Figure 3E:
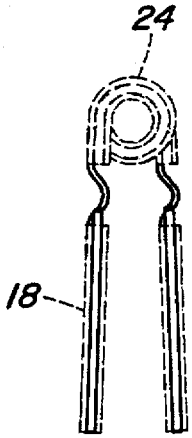
Fig. 3E (PRIOR ART)

Following the alignment step shown in FIG. 3D, the leg portions 18 are manually trimmed to the same length as shown in FIG. 3E. The coiled-coil filament members 12 are then sintered in hydrogen to stress relieve and to set the coil shape. During this operation, the legs must be held in the exact position that is finally required. It should be understood that throughout the previously outlined steps, there are a significant number of steps that are done manually which, by the nature of such an operation, will likely result in variation in the actual characteristics of the filament members 12 as well as proving significantly more expensive and time consuming to manufacture. In fact, even after the sintering process, a manual step of removing the sintering form 36 is required. Once the sintering form 36 is removed, the leg portions 18 of the coiled-coil filament member 12 are Picco or wax dipped so that the primary mandrel in the leg portions 18 remains intact and forms the spud members 38 of the finished coiled-coil filament 12 once the primary mandrel is dissolved. Then, to finish the coiled-coil filament manufacture, the Picco or wax dipping must be removed before the filament member 12 can be inserted and sealed into the lamp envelope 14.

In contrast to the multitude of manufacturing steps used in producing the prior art coiled-coil filament member 12, many of which are manually performed, the present invention as described with reference to FIGS. 4 through 6D provides a coiled-coil filament 40 which is readily adaptable to a high speed automated manufacturing operation such that all filaments coming off of the production line are substantially similar to one another, and wherein such production is accomplished at a cost and time savings as compared to existing techniques. Moreover, the coiled-coil filament member 40 of the present invention is provided with a new and improved leg portion configuration that avoids the need for a spud member and yet provides the necessary support strength both during lamp assembly as well as during continued lamp operation. In some cases, however, although the spud may not be needed for support, a spud may be provided to maintain seal integrity throughout the life of the lamp. Additionally, by the alignment of the leg portions 42 in a parallel manner for substantially the entire lengths thereof, the present coiled-coil filament member 40 allows for a more precise alignment of the main coil body portion 44 within the lamp envelope 14. It has been found that, in the coiled-coil filament configurations such as found in the prior art, by virtue of the offset alignment at the tops of the leg portions 18, if the pinch seal process is not exact, the step of pinch sealing the lamp envelope can have the effect of tilting the alignment of the main coil body away from the desired central position within the lamp envelope 14.

As seen in FIG. 4, coiled-coil filament member 40 of the present invention includes the main coil body 44 which is substantially the same as that of the prior art; that is, the main coil body 44 is comprised of a secondary coil portion wound using a primary coil portion. However, unlike the coiled-coil filament of the prior art, the filament member 40 of the present invention utilizes the primary coil portion in a continuous manner, from the leg portions 42 through the main coil body 44, and the use of spacers 26 between such leg portions 42 and main coil body 44 is avoided. Moreover, unlike the coiled-coil filament of the prior art, the present invention provides a coiled-coil filament 40 which does not always require the use of a spud member in the leg portions 42.

FIG. 5 illustrates the application of the coiled-coil filament member 40 of the present invention into the tungsten-halogen light source 10 as was shown in FIG. 1. The coiled-coil filament 40 is disposed at about the central region of the light envelope chamber 46 with the leg portions of the filament member 40 extending downward in a parallel manner to one another into the seal region 16 of the lamp envelope 14. The parallel relationship of the leg portions 42 is achieved by a helical bend 48 which is made where the leg portions extend off from the main coil body 44. It can be appreciated that by the use of the spacer 26 of the prior art coiled-coil filament 12, such a bend which allows for the parallel relationship of the leg portions could not readily be achieved without adversely affecting the spaced primary coiling at the spacer region 26.

Similar to the light source 10 of FIG. 1, the leg portions 42 of the coiled-coil filament 40 are welded to molybdenum foil members 20 on one end. Welded to opposite ends of the molybdenum foil members 20 are lead wires 22 which extend out from the lamp envelope 14 to provide for connection of power to the light source 10.

In addition to the benefits provided by the coiled-coil filament member 40 of the present invention in terms of the strength and mounting advantages of the parallel configuration of the leg portions 42, the present invention can be achieved by means of a manufacturing operation that yields benefits in terms of cost, manufacturing time and uniformity of results for all production runs. The manufacturing operation can be seen in FIG. 6A as requiring a continuous run of primary coiling 52 over a length of wire, such primary coiling being wound on a primary mandrel similar to that used in FIG. 3A but without the need for a cam member to provide spacers 26 since such spacers have been eliminated. FIGS. 6B and 6C show respectively a front view and a side view of the primary coil wound on a secondary mandrel so as to achieve the main coil body 44. From the side view perspective of FIG. 6C, it can be seen that the leg portions are parallel to one another and that their respective lengths are substantially the same. The attainment of the parallel leg portion 18 configuration can be achieved by means of overwinding the secondary coiling operation a predetermined amount that accounts for the fact that the coil leg portions will spring back such predetermined amount into the parallel alignment as shown in FIG. 6C. Each of the steps of overwinding the secondary coiling to allow for springing back to the parallel alignment and the trimming of the coil lengths are accomplished by use of automated equipment thereby avoiding the use of costly and time-consuming manual labor and also insuring that the results will be uniform and readily repeatable over a large production run and over a long period of time.

Following the steps of overwinding and trimming discussed above, the coiled-coil filament 40 is lighted, that is, a voltage is applied with the coiled-coil filament in forming gas typically comprised of $H_2$ and $N_2$. The applied voltage is that voltage just below what would ordinarily melt the primary mandrel, and is applied to set the shape of the coiled-coil filament member 40. In this manner, the coiled-coil filament of the present invention is locked in the desired shape without the need for the manual installation of a sintering form and without the need to perform an actual sintering operation. Additionally, with this form setting operation of the present invention, each coil can be set in shape immediately after coiling rather than having to perform a batch furnace operation to anneal and set the coil shape of a batch of filaments as is done using the process of the prior art. Following the step of setting the shape of the coiled-coil filament 40, the primary mandrel may then be dissolved in its entirety without leaving spud members within the leg portions 42 of the filament 40. In this manner, it should be appreciated that the step of Picco or wax dipping of the leg portions so as to allow for the formation of the spud members of the prior art coiled-coil filament 12 has been avoided. Also avoided is the subsequent step of removing the Picco or wax-dipping material prior to sealing the filament member 12 into the lamp envelope. Once the primary mandrel has been dissolved, the coiled-coil filament 40 can be mounted and sealed into the lamp envelope 14 and sealed using either a pinch or press seal technique or a heat shrink technique, all of which are well known in the lighting field.

Although the hereinabove described embodiment constitutes the preferred embodiment of the invention, it should be understood that modifications can be made thereto without departing from the scope of the invention as set forth in the appended claims.

What is claimed is:

1. A lamp comprising:

a lamp envelope;

a filament member disposed within said lamp envelope and sealed therein at a seal region formed on said lamp envelope;

lead wires extending into said seal region and connected to said filament member so as to enable energization of said filament member;

said filament member including a primary coil winding wound on a first mandrel member so as to achieve a substantially uniform distance between successive coil segments of said primary coil winding thereby avoiding spaces therebetween;

said filament member including a secondary coil winding formed by winding a first portion of said primary coil winding on a second mandrel, said secondary coil winding forming a main coil body; and wherein end portions of said primary coil winding form leg portions of said filament which extend away from said main coil body into said seal region of said lamp envelope in a substantially parallel manner to one another, said uniform distance between successive coil segments being maintained in a continuous manner throughout said leg portions and said main coil body.

2. A lamp as set forth in claim 1 further comprising molybdenum foil members interposed between said leg portions and said lead wires, said molybdenum foil members being sealed within said seal region of said lamp envelope.

3. A lamp as set forth in claim 1 wherein a helical bend is formed at the junction between said main coil body and each of said leg portions so that said leg portions can extend toward said seal region in such substantially parallel relation to one another.

4. A lamp as set forth in claim 3 wherein said substantially uniform spacing of coil segments on said primary coil winding is maintained at said helical bends and for the lengths of said leg portions.

5. A lamp as set forth in claim 1 wherein said first and second mandrels are entirely removed from said filament member prior to said leg portions being sealed in said seal region of said lamp envelope, such removal of said first mandrel resulting in said leg portions being devoid of a spud member within any portion thereof.

* * * * *